US005710385A

United States Patent [19]

Myler

[11] Patent Number: 5,710,385

[45] Date of Patent: Jan. 20, 1998

[54] CELESTIAL CHIME BOX

[76] Inventor: David Gregory Myler, P.O. Box 537, Murwillumbah, N.S.W. 2484, Australia

[21] Appl. No.: 242,861

[22] Filed: May 13, 1994

[30] Foreign Application Priority Data

Jul. 6, 1993 [AU] Australia ..... 40046/93

[51] Int. Cl.[6] ..... G10D 13/08

[52] U.S. Cl. ..... 84/403; 84/406

[58] Field of Search ..... 84/402, 403, 406

[56] References Cited

U.S. PATENT DOCUMENTS

| | | | |
|---|---|---|---|
| D. 148,291 | 1/1948 | Emanuel | D56/1 |
| 4,909,124 | 3/1990 | Chang | 84/403 |
| 5,329,836 | 7/1994 | Stannard | 84/402 |

*Primary Examiner*—Cassandra C. Spyrou

[57] ABSTRACT

The CELESTIAL CHIME BOX is a MUSICAL INSTRUMENT comprising of a number of metal tubes (F3), of graduated length and of varying pitch. The tubes are set up parallel to each other atop a wooden support box (F1) and are designed to produce the various notes of a musical scale when struck by a suitable playing stick (F4).

3 Claims, 1 Drawing Sheet

CELESTIAL CHIME BOX

BRIEF SUMMARY

From the original Glockenspiel there have come many different types of percussion instruments, some with new ideas and others from old ideas. Some are using wooden sound bars (and even bamboo) while others are using different types of metal bars and different setups to produce their own unique musical sound.

The Celestial Chime Box, I believe, will add an interesting new dimension to this field of musical instruments. Many people have a fascination for wind-chimes and this invention will afford them an opportunity to play complete melodies on a chime-like musical instrument which sounds like tubular bells.

BRIEF DESCRIPTION

This is a musical instrument somewhat similar to a Glockenspiel, but different because the sound producing elements are round metal tubes (aluminum) as opposed to flat metal bars, and they are suspended rather than resting down on some surface.

DETAILED DESCRIPTION

The Celestial Chime Box generally consists of 18 metal tubes of varying lengths which produce the various notes in a musical scale; 13 of which are naturals and 5 which are sharp notes, i.e. CDEFGABCDEFGA, F#G#A#C#D#. However this number can vary slightly according to individual requirements.

Figure 3:
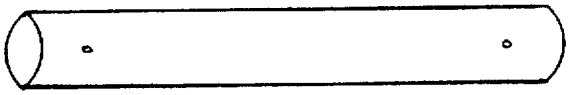
FIG. 3 illustrates a tube of the Celestial Chime Box.
Figure 4:
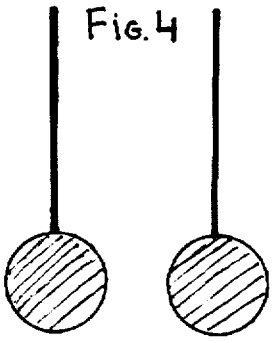
FIG. 4 illustrates playing sticks for use with the Celestial Chime Box.

The base of the instrument is a wooden box (FIG. 1 ), which is trapezoidal in shape, with the two ends a & b being parallel to each other, while the two sides c & d converge towards one another, thus making one end-wall (a) longer than the other (b). Along the top of each side-wall a series of long nails (rivet nails) are inserted, see FIG. 2*e*. These act as a support for the tubes. Each tube has a hole through each end approximately 2–3 inches from the end; see FIG. 3. An elastic cord is passed through each hole and attached onto the nail on either side, see FIG. 2*f*. This suspension of the tubes by means of an elastic cord provides the best means whereby the tubes can resonate freely with the least possible restriction. A very rich vibrant sound is thus produced when the tubes are struck with a suitable playing stick, of which the best seems to be that with a small wooden ball attached to a stick, FIG. 4.

Figure 1:
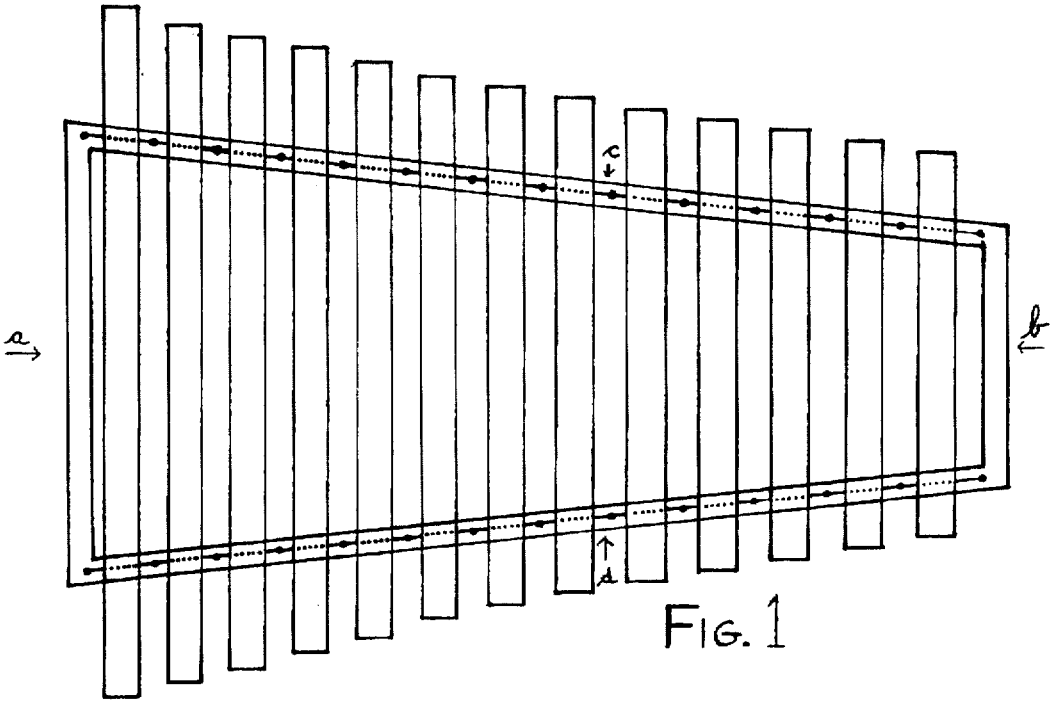
FIG. 1 illustrates the Celestial Chime Box.
Figure 2:
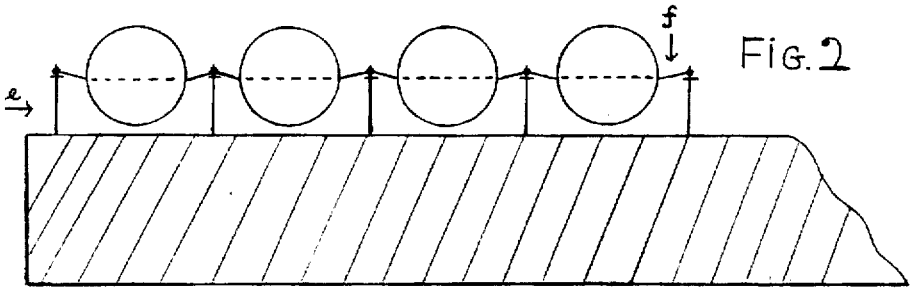
FIG. 2 illustrates a side view of the Celestial Chime Box.

The tubes are set up parallel to one another and graduate from the longest down to the shortest, as in FIG. 1. The instrument normally comprises of 13 tubes which are all the natural notes or those in the key C major. However, if one wishes to transpose the unit to another key one can easily remove some of the natural notes and replace them with some of the sharp notes (tubes) which are provided. A simple example would be; to change to the key of F one only has to remove B natural and replace it with B minor (A#). Similarly, other keys can be achieved by the same process thus enabling the instrument to be versatile in its application.

What is claimed is:

1. A musical instrument comprising;

a plurality tubes;

a base including a first side wall and an opposite second side wall;

a plurality of nails extending from each of said side walls; and, a first elastic cord attached to each of said nails extending from said first side wall and a second elastic cord attached to each of said nails extending from said second side wall; each of said tubes being suspended parallel to each other by said cords between adjacent ones of said nails.

2. The musical instrument according to claim 1, wherein:

each of said tubes having a hole through each end;

said first elastic cord passing through the hole of each of said tubes at a first of said ends;

said second elastic cord passing through the hole of each of said tubes at a second of said ends.

3. The musical instrument according to claim 1, wherein said base being a trapezoidal wooden box having a closed bottom and an opposite open top.

* * * * *